United States Patent [19]

Waller

[11] 4,290,710

[45] Sep. 22, 1981

[54] METAL FASTENING PLATE

[75] Inventor: Arthur Waller, Highland Park, Ill.

[73] Assignee: Bull Dog Lock Co., Chicago, Ill.

[21] Appl. No.: 128,733

[22] Filed: Mar. 10, 1980

[51] Int. Cl.[3] ..... F16B 12/00

[52] U.S. Cl. ..... 403/306; 403/406; 312/111; 248/475 R

[58] Field of Search ..... 248/475 R, 476, 477; 403/405, 306, 406, 4; 312/111

[56] References Cited

U.S. PATENT DOCUMENTS

| | | | |
|---|---|---|---|
| 511,660 | 12/1893 | Sprague | 403/406 |
| 962,939 | 6/1910 | Call | 403/406 |
| 3,003,600 | 10/1961 | MacKenzie | 403/4 |
| 3,940,212 | 2/1976 | Gutner | 403/405 |

FOREIGN PATENT DOCUMENTS

| | | | |
|---|---|---|---|
| 265089 | 2/1927 | United Kingdom | 403/403 |
| 1210223 | 10/1970 | United Kingdom | 403/405 |

*Primary Examiner*—Andrew V. Kundrat

*Attorney, Agent, or Firm*—McDougall, Hersh & Scott

[57] ABSTRACT

A metal plate for fastening furniture together is comprised of a strip of metal having two longitudinal apertures sequentially located along the length of the strip and flanges formed along the longitudinal edges of the strip. The flanges reinforce the strip making bending of the strip more difficult. Screws inserted through the apertures captivate the plate to adjacent pieces of furniture. The longitudinal apertures allows continuously variable selection of distances between mounting screws.

2 Claims, 4 Drawing Figures

METAL FASTENING PLATE

BACKGROUND OF THE INVENTION

This invention relates to the field of joining adjacent pieces of furniture with a metal fastening plate.

Prior to the present invention, a metal plate having two or more spaced holes has been employed to fasten furniture together. Such plates are placed flat against two adjacent pieces or units of furniture with at least one hole overlapping each piece. Wood screws inserted through these holes lock the plate to each piece of furniture. Normally, two or more plates are used.

These plates suffer several disadvantages. Often the unit of furniture which is to support another unit has only a narrow structural element adjacent to the unit to be supported. A common example of this situation is a dresser supporting a mirror where only the top of the dresser has sufficient strength to support the mirror mounted by a frame. The frame also has only a limited suitable area. It is desirable to locate the fastening plates so that the mounting screws are along the center line of the structural element of both units. This cannot always be accomplished by using the prior art plate because the fixed hole spacing employed in such plates defines a fixed distance between mounting screws. If such plates are mounted at an angle (with respect to vertical) to accommodate different spacings, undesirable forces on the plate results. The present invention overcomes this disadvantage by making the distance between mounting screws selectable. This invention allows furniture to be easily joined together with screws located along the center line of major structural elements.

Another disadvantage of the prior art plate previously described is that with the plate held in the appropriate mounting position, it is very difficult to see the exact mounting screw location because it must be viewed through the small mounting hole in the plate. The precise screw location is important for several reasons. First, any exiting screws, pins, or nails must be avoided. Second, if located too close to the edge of a surface, the screw may break through or mar the surface. The embodiment of this invention provides increased visibility of the screw location when held in position for mounting thereby overcoming this problem.

After the units are fastened together, it is sometimes desirable to readjust the distance between the units. This might be for purely aesthetic reasons or to serve a functional purpose such as to level the supported unit. If the fixed screw spacing of the prior art plate would allow such a change, new mounting holes would have to be used. The fastening plate embodying the current invention makes readjustment easy since only a mounting screw need be loosened and tightened after the desired adjustment is made. No new mounting holes are required.

SUMMARY OF THE INVENTION

The instant invention provides an improved metal fastening plate comprised of a longitudinal metal strip having two longitudinal slots located sequentially along the length of the strip and having reinforcing flanges located along each longitudinal edge of the strip. At least one screw is inserted through each slot locking the plate to adjacent pieces of furniture to be joined.

A primary object of the present invention is to provide a new and novel furniture fastening plate which may be used to easily and accurately join furniture together. Other features and advantages of the present invention include:

(a) increased visibility of the mounting area so that the exact screw location may be observed relative to the edge of the unit;

(b) a continuous selectable range over which mounting can be most advantageously selected for a particular piece of furniture; and (c) the ability to adjust the distance between joined pieces of furniture without having to completely remove and relocate the mounting screws.

The above advantages, features and objects of this invention are offered by way of example. The above features and advantages of the present invention will become apparent to those skilled in the art from the following description and from reference to the drawings.

DETAILED DESCRIPTION

Figure 1:
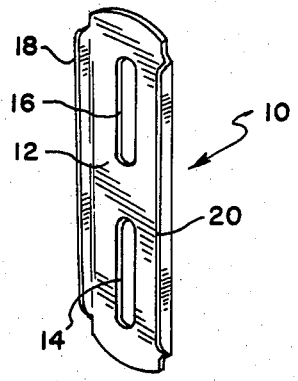
FIG. 1 is an isometric view of a fastening plate embodying the present invention.

Now referring in particular to FIG. 1, a fastening plate 10 embodying the present invention is illustrated. Fastening plate 10 is comprised of a strip of metal 12 having longitudinal apertures 14 and 16 located sequentially along the length of strip 12 and having flanges 18 and 20. Metal strip 12 is preferably made of a strong inflexible material such as steel. Metal fastening plate 10 may be economically and conveniently made from a single piece of steel by stamping apertures 14 and 16 and bending the longitudinal edges of metal strip 12 substantially perpendicular to the strip thereby forming flanges 18 and 20.

Figure 2:
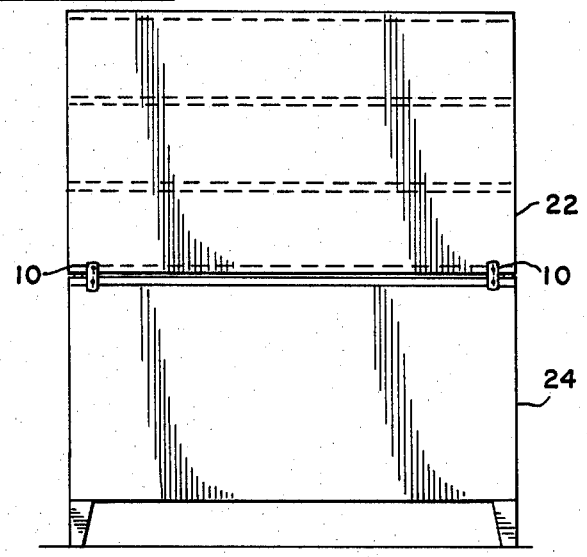
FIG. 2 illustrates two pieces of furniture being joined by an embodiment of the present invention.

Now referring to FIG. 2, a pair of fastening plates 10 are shown joining an upper piece (unit) of furniture 22 to a lower piece (unit) of furniture 24. FIG. 2 is a view of the back or rear of furniture 22 and 24. An example of fastening particular pieces of furniture with the present invention is joining a mirror carried by a wood frame to a dresser. Another specific application of this invention is to join pieces of furniture employing a modular or stacking concept.

Figure 3:
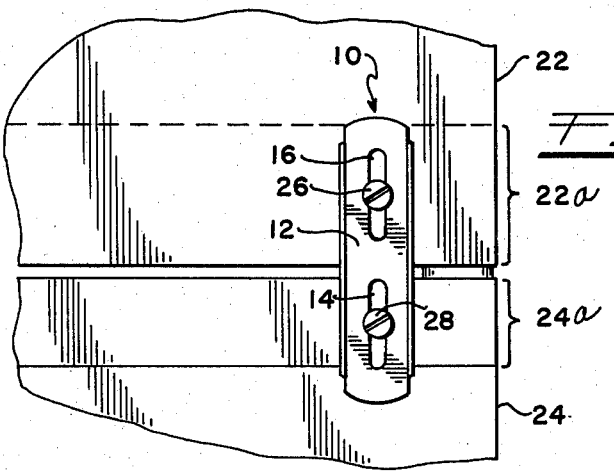
FIG. 3 is a fragmentary exploded view taken from FIG. 2 illustrating in detail the embodiment of the present invention.

Now referring to FIG. 3, plate 10 is shown in greater detail fastening together pieces of furniture 22 and 24. Pieces of furniture 22 and 24 have structural elements **22*a* and 24*a* respectively. That portion of furniture 24 below structural element portion 24*a* generally consists of panels or sheets of veneer not capable of supporting furniture piece 22. Therefore, only portion 24*a* may be utilized for joining furniture piece 22 with furniture 24. Similarly, only portion 22*a* should be used for joining plate 10 to unit 22**.

Screw 28 mounts metal plate 10 to structural element **24*a*. The body of screw 28 passes through aperture 14 with the head of screw 28 captivating metal plate 10 to unit 24. Screw 28 is shown in FIG. 3 mounted along the center line of structural element 24***a*. It is desirable to mount screw 28 near the center of the structural portion in order to achieve maximum strength. If screw 28 were placed too close to the upper edge of portion 24*a*, not only would poor holding strength result, but the body of screw 28 might crack or break through the surface defining the upper edge of portion 24*a*. For example, 24*a* might represent a table top which would be marred should the body of screw 28 break through the surface of the table top. Similar considerations are equally applicable to piece of furniture 22 and portion 22*a* thereof.

As shown in FIG. 3, screws 26 and 28 are mounted to the center of sections 22*a* and 24*a* respectively. Apertures (slots) 14 and 16 provide the user with sufficient visibility to easily locate the desired center of the structural elements and to view the exact screw location with respect to the edge of the unit.

If a specific distance between pieces of furniture 22 and 24 is important or an adjustment desired, plate 10 in conjunction with screws 26 and 28 makes setting the desired distance or an adjustment easy. With screws 26 and 28 loosened such that the heads of the screws do not tightly captivate plate 10 against furniture pieces 22 and 24, the furniture pieces may be adjusted as desired and screws 26 and 28 then tightened to fasten the pieces of furniture together at this desired position. The convenient method of adjustment accomplished by plate 10 also enables one to easily level furniture pieces 22 even if the lower piece 24 is not level. Furniture pieces 22 and 24 are easily adjusted with respect to each other once mounting screws 26 and 28 are loosened allowing plate 10 to move vertically within the limits of apertures 14 and 16.

Figure 4:
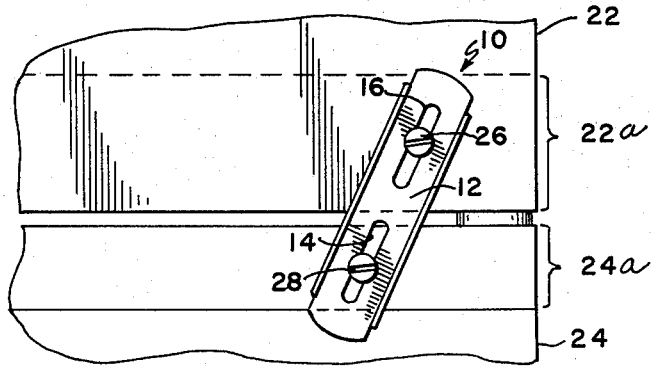
FIG. 4 is a fragmentary exploded view illustrating the embodiment of the present invention employed in a different configuration to join adjacent pieces of furniture.

Now referring to FIG. 4, an alternating use of plate 10 embodying the current invention is shown. Here a pair of plates 10 are mounted at an angle with respect to vertical (only one plate is illustrated). This position enables the user to easily align the sides of furniture 22 and 24 (right hand edge as seen in FIG. 4). Furniture piece 22 is mounted to 24 with their sides in approximate alignment. Plate 10 is then mounted as shown in FIG. 4. Mounting screw 26 is then loosened allowing unit 22 and mounting screw 26 to move at an angle defined by aperture 16. A general upward or downward movement of piece 22 also causes horizontal movement because aperture 16 is mounted at an angle with respect to vertical. This action makes aligning the sides of furniture 22 and 24 easily accomplished. Plate 10 reinforced by flanges 18 and 20 enables this plate to withstand forces tending to bend the plate sideways not present when mounted vertically.

The following modifications and applications are contemplated by the current invention. More than one screw per piece of furniture could be utilized. An irregular or rough surface of strip 12 which engages the furniture would increase the coefficient of friction between that surface and the furniture. Although vertical stacking of furniture has been illustrated, the advantages of the current invention are also beneficial in horizontal fastening. Objects other than furniture could also be joined.

While an embodiment of this invention has been shown and described in some detail, it will be understood that this description and illustrations are offered merely by way of example and the invention is to be limited in scope only by the appended Claims.

What is claimed is:

1. A metal plate furniture fastening for fastening two adjacent pieces of furniture with screws being used to secure said plate to said furniture, the plate comprising at least two screws in combination with:

a longitudinal metal strip having an enclosed longitudinal aperture of uniform width for receiving said screws, said aperture being of sufficient length to substantially overlap each of the two adjacent pieces of furniture permitting a continuous selection of two screw locations along said aperture, and flanges formed by bending the longitudinal edges of said strip substantially perpendicular to said strip, whereby the two screws are inserted through said aperture with at least one screw securing each piece of furniture to said strip, thereby fastening said furniture together with said plate.

2. A fastening plate for joining two adjacent pieces of furniture together utilizing screws, said plate comprising:

a longitudinal metal strip having at least two completely enclosed longitudinal apertures of uniform width for permitting a continuous selection of screw locations along the entire length of each aperture, said apertures extending sequentially along the length of the strip, each of the apertures being of sufficient length to substantially overlap one of the two adjacent pieces of furniture, and reinforcing flanges extending along the longitudinal edges of said strip, whereby one screw inserted through an aperture secures one piece of furniture to the strip, the other piece of furniture secured to the strip by a second screw inserted through another aperture, thereby the plate joining two adjacent pieces of furniture together.

* * * * *

UNITED STATES PATENT OFFICE

CERTIFICATE OF CORRECTION

Patent No. 4,290,710 Dated September 22, 1981

Inventor(s) Arthur Waller

It is certified that error appears in the above-identified patent and that said Letters Patent are hereby corrected as shown below:

Claim 1, line 1, "A metal plate furniture fastening" should read -- A metal furniture fastening plate --

Signed and Sealed this

First Day of December 1981

[SEAL]

Attest:

GERALD J. MOSSINGHOFF

Attesting Officer

Commissioner of Patents and Trademarks